US008336873B2

(12) United States Patent
Takahashi

(10) Patent No.: US 8,336,873 B2
(45) Date of Patent: Dec. 25, 2012

(54) MEDIA FEEDING APPARATUS AND IMAGE FORMING APPARATUS

(75) Inventor: Hideaki Takahashi, Miyagi (JP)

(73) Assignee: Ricoh Company, Limited, Tokyo (JP)

( * ) Notice: Subject to any disclaimer, the term of this patent is extended or adjusted under 35 U.S.C. 154(b) by 98 days.

(21) Appl. No.: 12/206,412

(22) Filed: Sep. 8, 2008

(65) Prior Publication Data

US 2009/0014948 A1 Jan. 15, 2009

(30) Foreign Application Priority Data

Sep. 7, 2007 (JP) ..... 2007-232790
Jun. 2, 2008 (JP) ..... 2008-144656

(51) Int. Cl.
*B65H 3/14* (2006.01)

(52) U.S. Cl. ..... 271/97; 271/98; 271/104

(58) Field of Classification Search ..... 271/97, 271/98, 104, 105
See application file for complete search history.

(56) References Cited

U.S. PATENT DOCUMENTS

| | | | | |
|---|---|---|---|---|
| 5,813,669 | A * | 9/1998 | Horii | 271/12 |
| 5,921,540 | A * | 7/1999 | Acquaviva et al. | 271/98 |
| 6,729,614 | B2 * | 5/2004 | Okazaki et al. | 271/97 |
| 6,942,208 | B2 * | 9/2005 | Okazaki et al. | 271/97 |
| 7,677,553 | B2 * | 3/2010 | Ikeda | 271/98 |
| 2005/0285326 | A1 * | 12/2005 | Uji et al. | 271/97 |
| 2009/0127768 | A1 * | 5/2009 | Shima et al. | 271/97 |

FOREIGN PATENT DOCUMENTS

| | | | |
|---|---|---|---|
| JP | 11-5643 | | 1/1999 |
| JP | 2003-63675 | | 3/2003 |
| JP | 2005314094 | A * | 11/2005 |
| JP | 2006-27796 | | 2/2006 |
| JP | 2006264946 | A * | 10/2006 |
| JP | 2007-8656 | | 1/2007 |

* cited by examiner

*Primary Examiner* — Luis A Gonzalez
(74) *Attorney, Agent, or Firm* — Oblon, Spivak, McClelland, Maier & Neustadt, L.L.P.

(57) ABSTRACT

A media feeding apparatus that includes a media storage device, a blowing device, a media feeding member, and a media holding member, the media storage device storing media, the blowing device blowing toward side surface of the media, the media feeding device feeding the media sequentially, and the media holding member holding the media at a substantially same position as the media feeding device with respect to the media feeding direction.

20 Claims, 12 Drawing Sheets

MEDIA FEEDING APPARATUS AND IMAGE FORMING APPARATUS

CROSS-REFERENCE TO RELATED APPLICATIONS

This application is based upon and claims priority under 35 U.S.C. §119 to Japanese Patent Applications No. 2007-232790, filed Sep. 7, 2007 and No. 2008-144656, filed Jun. 2, 2008, the entire contents of which are hereby incorporated by reference.

BACKGROUND OF THE INVENTION

1. Field of the Invention

The present invention relates to a media feeding apparatus which feeds a stacked sheet-like medium to a processing apparatus. Especially, the present invention relates to a media feeding apparatus for image forming apparatuses such as copiers, printers, fax machines, etc and an image forming apparatus including the media feeding apparatus.

2. Description of the Background Art

Conventionally, a media feeding apparatus which separates and feeds stacked sheet-like media one by one has been known. This media feeding apparatus has been used for image forming apparatuses such as copiers, printers, etc.

These image forming apparatuses have a sheet feed cassette or a sheet feed tray which stacks sheet-like media for forming an image on the media (such as papers and sheets for overhead projectors) and feeds them into the image forming apparatus.

Recently, media for the image forming apparatuses have diversified due to the spread of color copiers, color printers and such. Non-plain paper, such as a coated paper, art paper, film lined paper, thick paper, and extra-thick paper (Kent paper, etc.) have been used in image forming apparatuses. These types of paper have features such a high smoothness of the surface and high hygroscopic nature. When these types of paper are in a stack, the negative pressure between the papers causes a strong adherence force between the papers. As a result, the separability of the papers is poor and causing problems such as multi-feeding and miss-feeding, instead of the papers being separated one by one and fed into the image forming apparatus. This problem occurs not only with paper but also with other materials which have a high adherence force such as sheets for overhead projectors.

Moreover, a similar problem may occur as a result of the condition of the stack which causes the adherence force to be high. As described above, in the stack of media which has a high adherence force such as more than about 100 gf the media is not able to be separated one by one by typical rollers of a media feeding apparatus because the media sticks together.

Japanese Patent Application Laid-Open No 1999-5643 (referred to as related application 1) describes a technique of feeding media one by one correctly from such a media stack.

In this application, air flow is controlled such that the upper side of uppermost sheet has negative pressure. Thus, the sheets are separated one by one by this lift force toward the upper side of the sheets as a result of the negative pressure.

In addition, in a technique for a media feeding mechanism which improves separation performance by air flow, Japanese Patent Application Laid-Open No 2003-63675 (referred to as related application 2) discloses that a floatation suppression member is arranged between air outlets and a sheet feeding roller to suppress a degree of sheet lift.

In this application, the sheet feeding apparatus is arranged so that sheets are steadily separated and stably fed one by one regardless the sheet size in the sheet feeding apparatus described in the related application 1. In this invention, the upper few sheets of the stack are floated with gap between the sheets and separated one by one even though the sheets have high adherence force due to the floatation suppression member arranged between the air outlets and the sheet feeding roller.

However, related application 2 is not able to obtain enough floatation suppression with respect to the air flow because the floatation suppression members are mounted on lateral adjusting members (i.e., side fences). That is to say, as shown in FIG. 1, the air blown by fan 501*a* via an outlet disposed in side fence 502 directly contacts the air blown by fan 501*b* via an outlet disposed in the other side fence 502 forcing the air to blow towards near the center of the sheet P held by the side fences 502 and an end fence 503. The air is then changes flowing direction and flows forward with respect to the sheet feeding direction. The air flowing forward with respect to the sheet feeding direction then contacts a feeding roller 505 pressing sheets via narrow space A between floatation suppression members 504 mounted on the side fences 502. The air then flows around the feeding roller 505 and out to in front of the sheet from the side of the feeding roller 505 (the direction is shown by the arrow B in FIG. 1). Because of this air flow, the sheet P is made to float at the side portion of the feeding roller 505 arranged at forward portion of the sheet with respect to the sheet feeding direction. Thus, the feeding resistance of the sheet P is increased due to the floatation and there is caused a conveying malfunction in that the feeding roller 505 is unable to feed the sheet correctly (i.e., paper jam).

As described above, the techniques disclosed in the related applications does not consider the influence of air flow. As a result of this oversight, subsequent feeding of sheet is negatively influenced so that sheet separation by air flow is reduced.

SUMMARY

The present invention has been made in view of the above-mentioned circumstances.

It is an object of the present invention to at least partially solve the problems in the conventional technology.

A media feeding apparatus according to one exemplary aspect of the present invention includes a media storage device that stores media, a blowing device that blows toward a side surface of the media, a media feeding device that feeds the media sequentially, and a media holding member that holds the media at a substantially same position in the media feeding device with respect to the media feeding direction.

According to the above-described media feeding apparatus, it is possible to improve separation performance of media while feeding, and feed the media correctly.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

DETAILED DESCRIPTION OF EXEMPLARY EMBODIMENTS

Exemplary embodiments of the present invention are explained in detail below with reference to the accompanying drawings.

Figure 1:
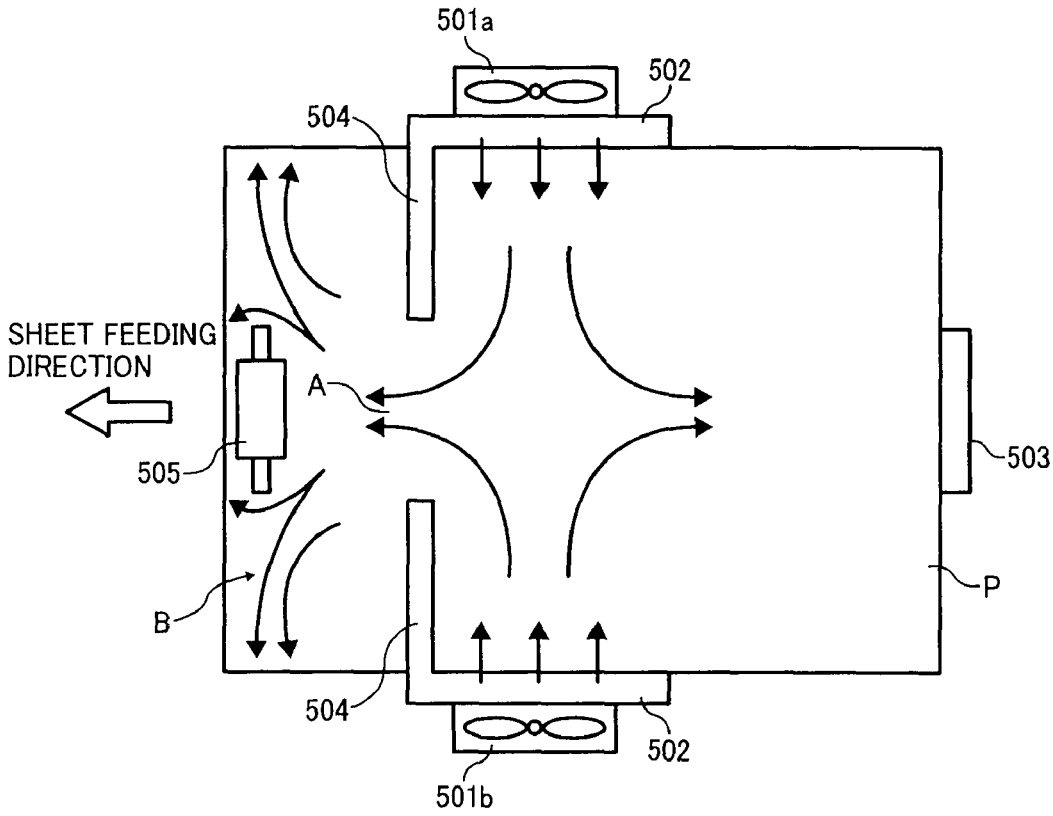
FIG. 1 BACKGROUND ART
FIG. 1 illustrates a top view of a conventional sheet feeding apparatus.
Figure 2:
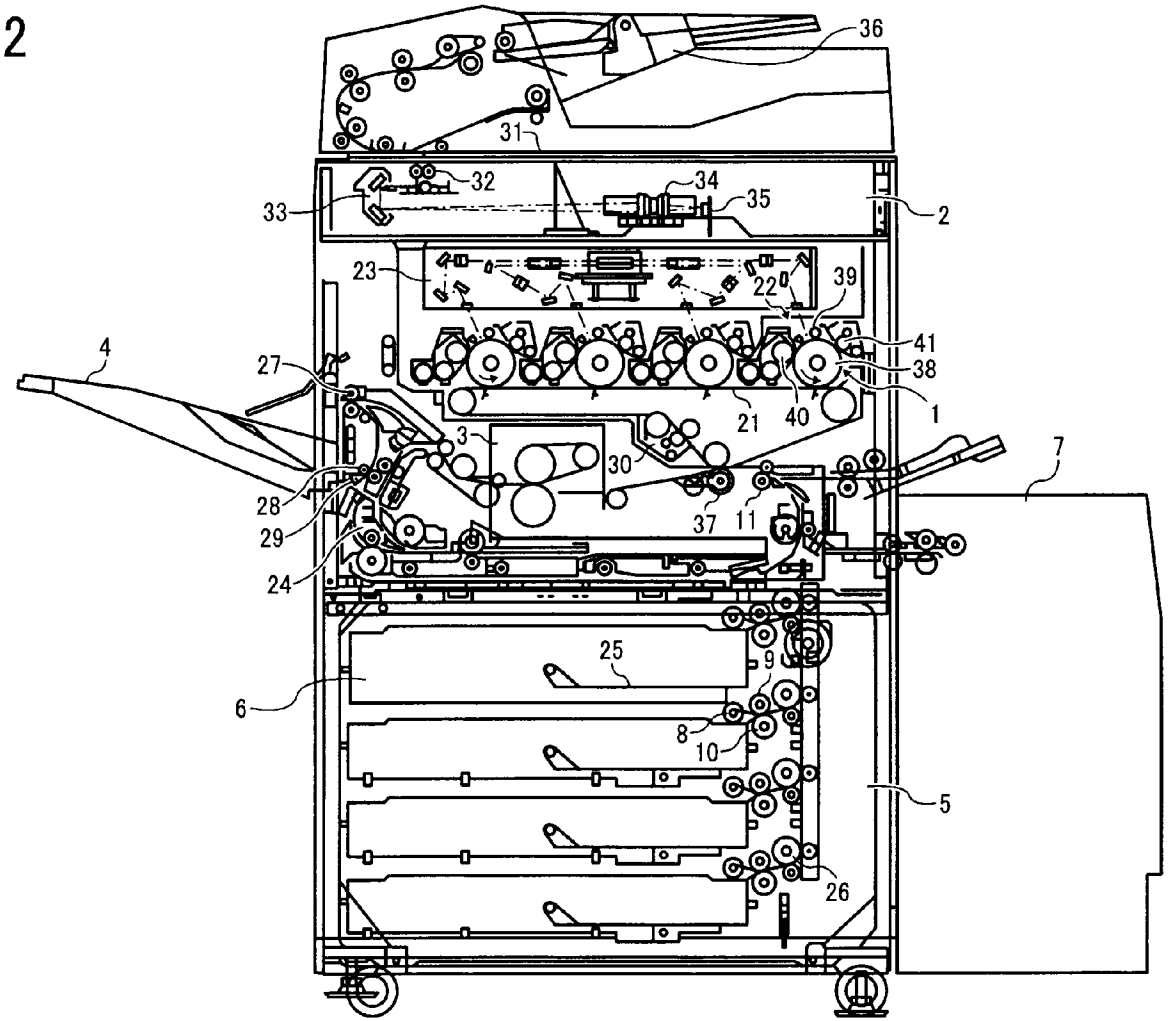
FIG. 2 illustrates an overall view of an image forming apparatus, for example, utilizing a media feeding apparatus which includes the present invention.
Figure 3:
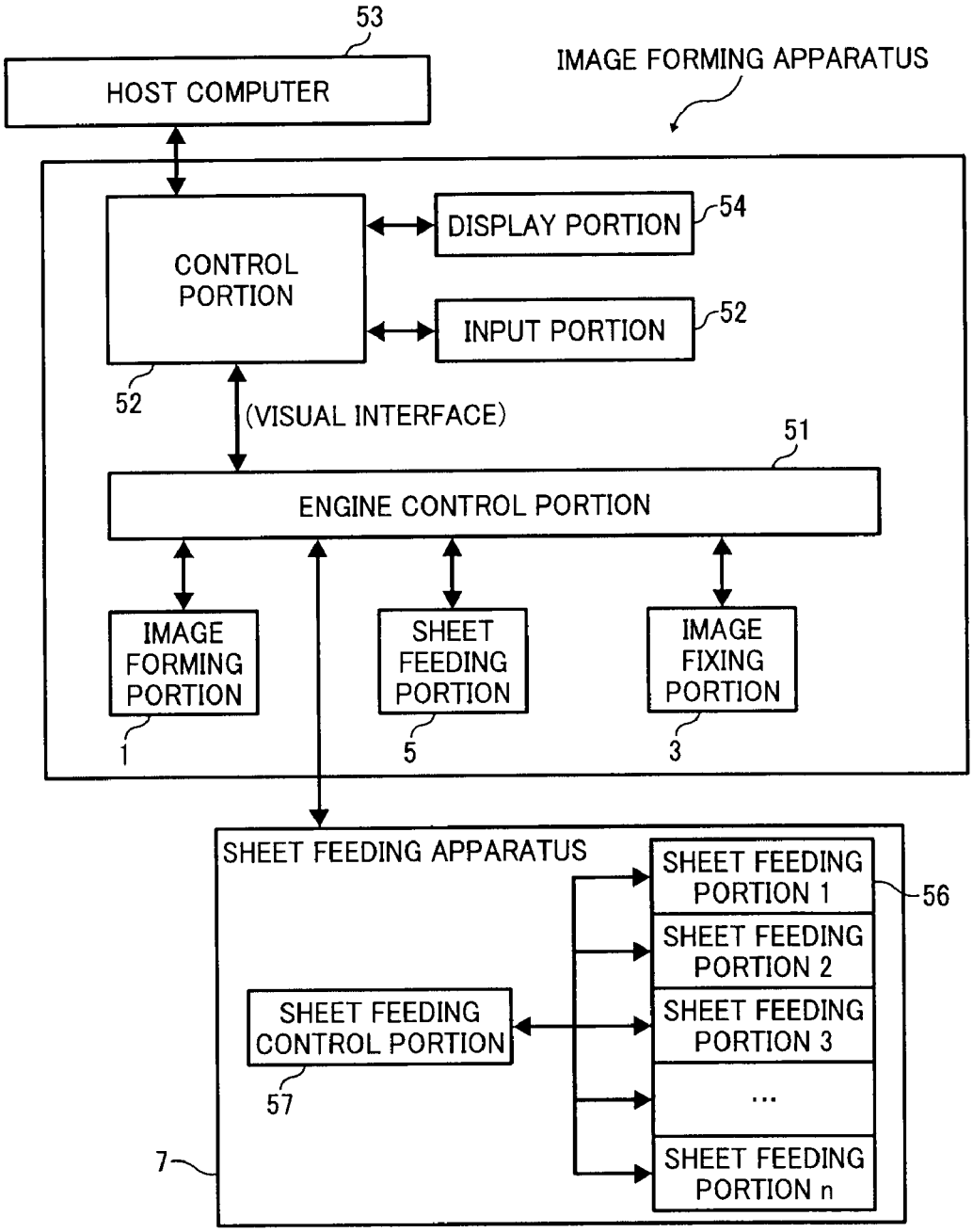
FIG. 3 illustrates a main control unit of an image forming apparatus utilizing a media feeding apparatus which includes the present invention.

FIG. 2 is an overall view of an image forming apparatus which includes a media feeding apparatus. FIG. 3 is a block diagram that illustrates a main control unit of the image forming apparatus.

The image forming apparatus noted above may include the functions of a digital color copier such as the ability to scan a document and to copy a digitalized image to a sheet.

As shown in FIG. 2, the image forming apparatus includes an image forming portion 1, a scanning portion 2, an image fixing portion 3, a discharging portion 4, etc. In addition, a sheet feeding portion 5 which has multiple tiers is disposed under the image forming apparatus. Sheet feeding trays 6 are configured in each tier of the sheet feeding portion 5 as a sheet feeding apparatus so as to stack recording media such as plain paper, enamel paper (i.e. coated paper), or sheets for an overhead projector. Moreover, the sheet feeding portion 5 is configured such that additional sheet feeding apparatuses 7 can be added as necessary.

When forming an image in the image forming apparatus, sheets are separated and fed sequentially one by one from a selected tray of the sheet feeding trays 6 or the sheet feeding apparatus 7. For example, an uppermost sheet in the sheet feeding tray 6 is fed by a pickup roller 8 and separated by a reverse roller 10. The separated sheet is fed out from the sheet feeding tray 6 and conveyed toward resist rollers 11 disposed downstream with respect to sheet conveying direction by a feeding roller 9.

The sheet separated and fed as described above is stopped temporarily and held in order to address the problem of the sheet bumping into a nip of the resist rollers 11. Then the sheet is conveyed toward the image forming portion 1 so that an image can be formed on the sheet.

The arrangement of the image forming apparatus in FIG. 2 is explained below, although detailed explanation of some portions is omitted. In FIG. 2, the image forming apparatus includes an intermediate transfer belt 21, an image forming portion 22, an exposure portion 23, a duplex device 24, a base plate 25 of the sheet feeding tray 6, sheet feeding rollers 26, sheet discharging rollers 27, reversal discharging rollers 28, a branch claw 29, an intermediate transfer belt cleaning device 30, a contact glass 31, carrier devices 32 and 33, a lens 34, a CCD 35, an automatic document feeder 36, a transfer device 37, a photosensitive device 38, a charging device 39, an image development device 40 and a cleaning device 41.

Furthermore, a control unit of the image forming apparatus is explained below with reference to FIG. 3.

In the image forming apparatus, an engine control portion 51 controls behaviors of the image forming portion 1, the sheet feeding portion 5 and the image fixing portion 3 as well as other similar portions. Alternatively, the engine control portion 51 may control only the image forming portion 1, the sheet feeding portion 5 and the image fixing portion 3. A control portion 52 is connected to an external host computer 53, a display portion 54 and an input portion 55 as well as other similar portions. Alternatively, the control portion 52 may be connected only to the external host computer 53, the display portion 54 and the input portion 55. The control portion 52 receives and administrates external information that may be necessary for operation and inputs information to the engine control portion 51, enabling the engine control portion 51 to control the whole system. The sheet feeding apparatus 7 includes sheet feeding portions 56, which includes at least one sheet feeding portion, and a sheet feeding control portion 57 which controls sheet feeding and sheet conveying. The sheet feeding apparatus 7 may correspond to a so-called large capacity tray. Although the sheet feeding apparatus 7 and the image forming apparatus are different apparatuses in this example (i.e., the sheet feeding apparatus 7 is an optional attachment), the image forming apparatus is able to be configured to include within itself the sheet feeding apparatus 7 along with the sheet feeding portion 5.

Figure 4:
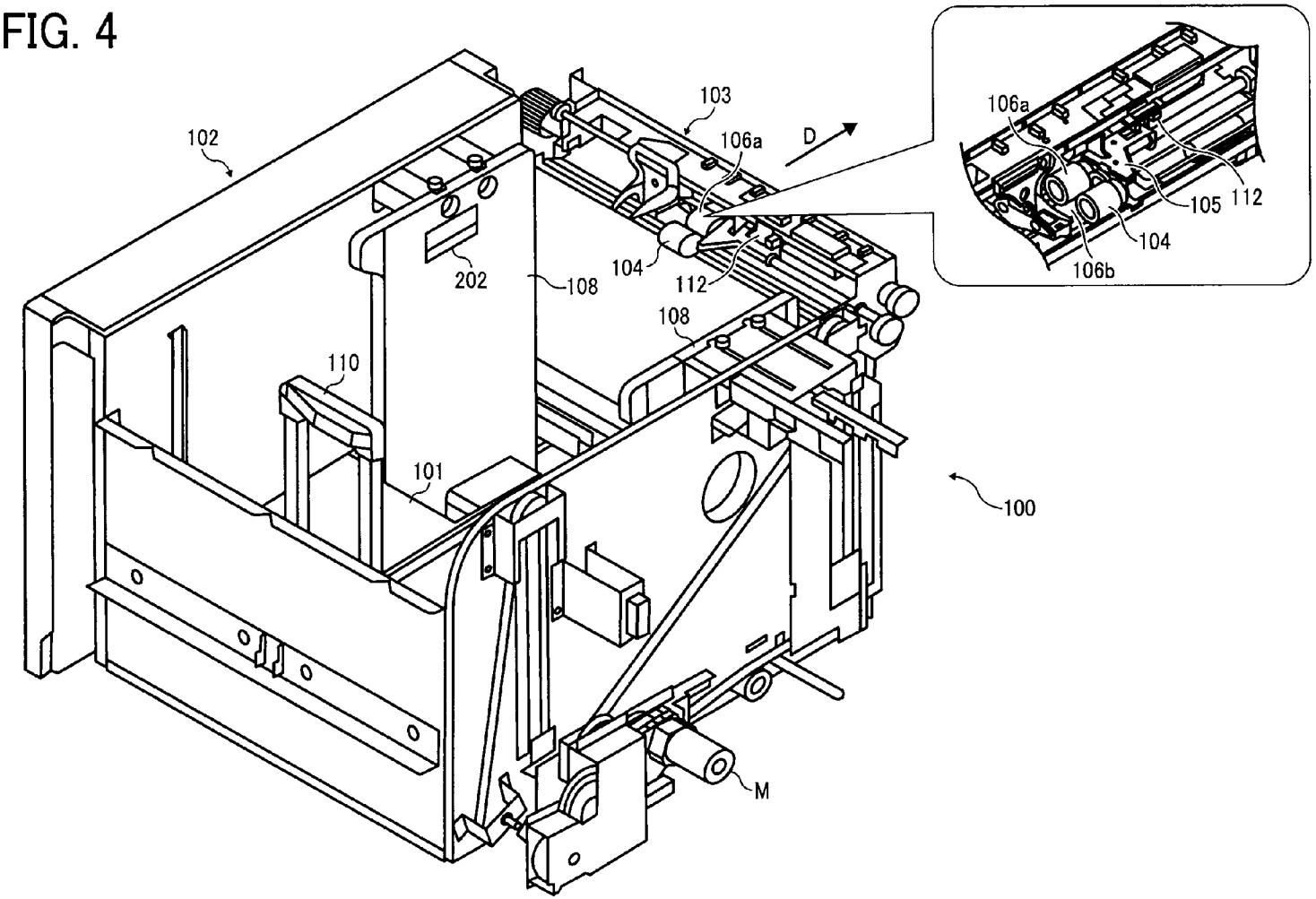
FIG. 4 illustrates an enlarged view of the sheet feeding apparatus shown in FIG. 2.

The details of the sheet feeding apparatus 7 will now be explained below with reference to FIG. 4. In this example, the sheet feeding apparatus 7 includes a sheet storage portion 102, which includes a base plate 101 which is used to stack sheets, and a sheet feeding unit 103 (a sheet feeding device) which separates an uppermost sheet from the sheet stack and feeds the sheet toward the image forming apparatus. The sheet feeding unit 103 includes a feeding roller 104, a separating roller 106*a*, and a reversing roller 106*b*. These rollers 104, 106*a*, 106*b* are rotated with a predetermined timing.

The sheet storage portion 102 includes side fences 108 which act as first holding members to guide a side surface of the sheets stacked on the base plate 101 in the across-the-width direction (i.e., the direction is orthogonal with respect to the sheet feeding direction) at the both sides of the sheet storage portion 102. In addition, the sheet storage portion 102 includes an end fence 110 which holds a rear edge surface of the sheets at the backside of the sheets.

An upper limit of the sheet stack (also referred as a sheet feeding position) is detected by a sensor 112 which is configured to include a photo interrupter. The sheet feeding position is detected by the sensor 112 and controlled positioning order to keep the position static by having the base plate 101 make an up-and-down motion via a motor M even as the sheet number is decreasing. As a result, the upper limit of the sheet stack is optimized to keep the sheet feeding position constant thus stabilizing the sheet feeding and separating even the number of sheets increases or decreases. In addition, an actuator 105 in correspondence with the sensor 112 is connected with the feeding roller 104 and the separating roller 106*a*. The upper limit of sheets is detected because a filler in the an edge portion of the actuator 105 trips the sensor 112, ensuring that the position of the feeding roller 104 is stabilized. The actuator 105 ensures detection of the position even when the base plate 101 moves upward corresponding to a decreased number of sheets. The sheet storage portion 102 is configured such that the sheet storage portion 102 can be drawn out and inserted freely from/into the main body of the sheet feeding apparatus 7. Thus, users are able to draw out the sheet storage portion 102 in order to load sheets in the sheet storage portion 102.

Figure 5:
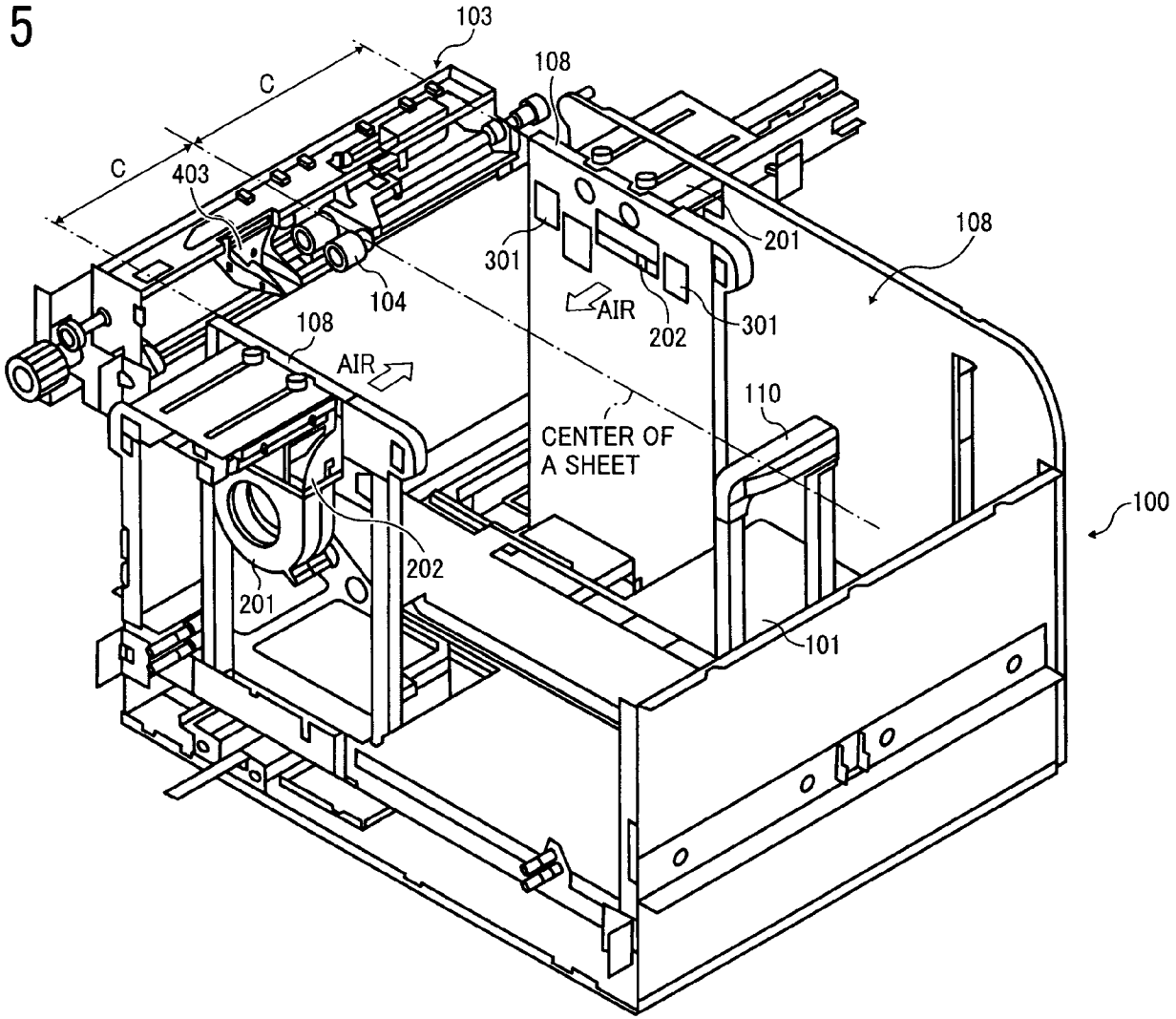
FIG. 5 illustrates a perspective view showing main features of the sheet feeding apparatus according to an exemplary embodiment.
Figure 6:
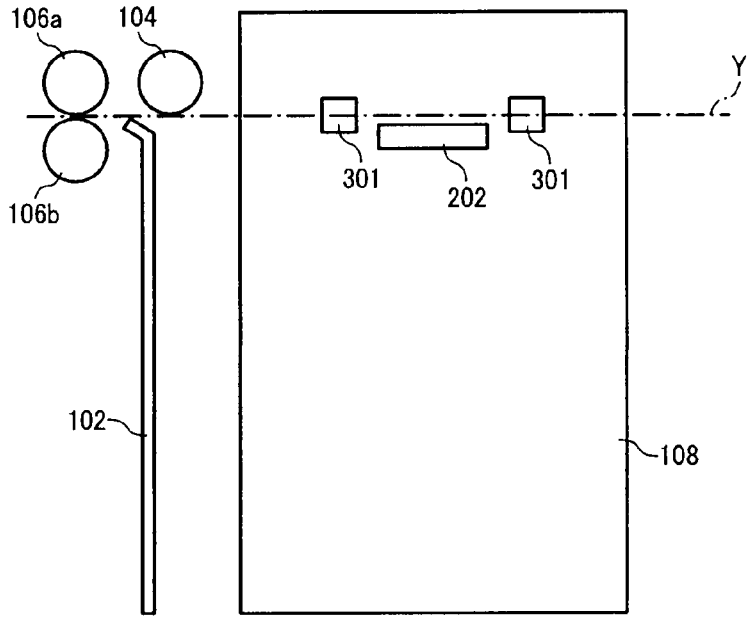
FIG. 6 illustrates a side view of the sheet storage portion of a sheet feeding apparatus according to an exemplary embodiment.

FIG. 5 is a perspective view that illustrates the main features of the sheet feeding apparatus 7. FIG. 6 is a side view of the sheet feeding apparatus 7.

As shown in FIG. 5, blower fans 201 are mounted on the outside of the both side fences 108 and act as ventilation devices. Further, air outlets (nozzles) 202 are opened inside surfaces of the both side fences 108 in order to emit the air generated by the blower fans.

As shown in FIG. 6, the air outlets 202 are arranged at the position that is lower than the sheet path Y which is a path of the sheet fed from the sheet storage portion 102. The opening of the air outlet 202 extends along the sheet path Y. By such an arrangement, the air blown by the blower fans 201 toward the center of the sheets via the air outlets 202 does not hit the upper most surface of sheets directly during sheet feeding. As a result, negative pressure is produced above the sheets. In addition, regulation members 301, such as sponges and thin stainless steel plates, are arranged at positions which are in front and behind the opening of the air outlets 202 with respect to sheet feeding direction. Further, the position of the regulation members 301 straddles the sheet path Y on the side fences 108. The regulation members 301 improve the handling performance of the sheets by pushing the sheet stack lightly from the side surface of the side fences 108.

In the following section, an additional aspect of the invention is explained below with reference to FIGS. 7, 8, 9A, 9B, 10A, and 10B.

Figure 7:
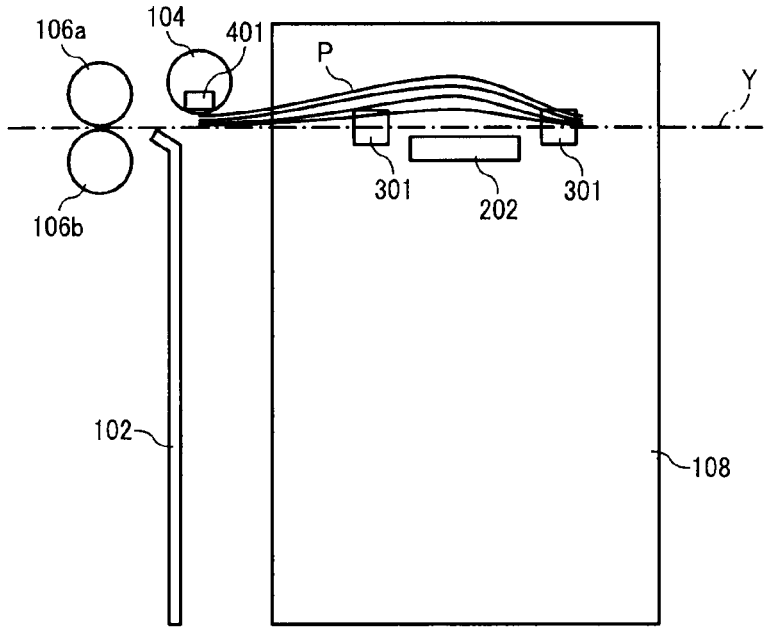
FIG. 7 illustrates a side view of the sheet storage portion of a sheet feeding apparatus according to an exemplary embodiment.

FIG. 7 shows the process by which a stacked sheet P is handled by the air blown via the air outlets 202. In order to progress the sheet P accurately toward the feeding roller 104 which is a media feeding device, it is preferable that the sheet P is bent as is illustrated in FIG. 7 when the air is blowing. As shown in FIG. 7, the edge of the sheet P contacts the feeding roller 104 at a substantially large angle with respect to a surface of the sheet path Y; this is because such a configuration allows more air to flow into front portion of the sheet P with respect to sheet feeding direction.

Figure 8:
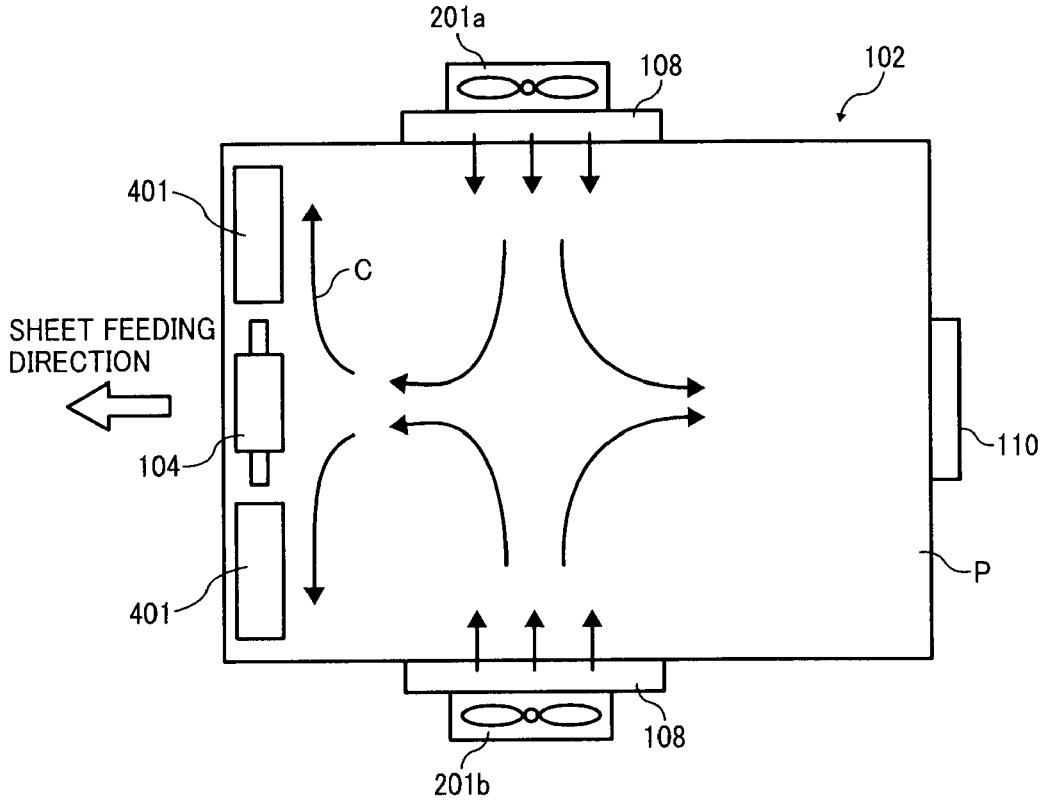
FIG. 8 illustrates a top view of the sheet storage portion of a sheet feeding apparatus according to an exemplary embodiment.

FIG. 8 shows a top view of the sheet storage portion 102 shown FIG. 6. In FIG. 8, the sheet storage portion 102 includes side fences 108, which hold in both side surfaces of the stacked sheet P and an end fence 110 which hold in the rear edge of the stacked sheet P. The position of the sheet P is fixed by the fences 108,110. In addition, the right and left side fences 108 each include a blower fan 201*a* and 201*b* (also referred to as a blower device) which are configured to blow air. The blower devices 201*a* and 201*b* are configured to blow air in an orthogonal direction with respect to the sheet feeding direction and against the side surface of the sheet stack P. The air blown from both side fences 108 contacts at the substantial center of the sheet P and changes flowing direction into a direction parallel with respect to the sheet feeding direction (the direction is illustrated as the horizontal direction in FIG. 8). Then the air passes between the coherent sheets P, and the coherence of sheets P is destroyed loosing the sheets. In addition, it is possible to adjust air volume or air blowing time in order to properly handle sheets that have a higher adherence force such as coated papers or sheets for an overhead projector.

It should be noted that in order to generate a better flexural shape of sheet P, it is preferable that the air flow be directed lateral to the sheet, which direction is shown by arrow C in FIG. 8, before reaching the feeding roller 104. Therefore, it is preferable to hold the sheet P down to be at a substantially same position as the feeding roller 104 with respect to the sheet feeding direction of the sheet P. In FIGS. 7 and 8, sheet holding members 401, which are produced with materials such an ABS and polycarbonate, are arranged at a position complimentary to this holding. The sheet holding members 401 can be a plate, a rib or a roller. However, in order to better form the flexural shape of the sheet P, it is preferable to hold the sheet using a plate.

Moreover, if no sheet hold members 401 shown in FIG. 7 are included in the configuration, the sheet moves up and down by air flow because the feeding roller 104 moves up and down in feeding. This causes instability of the sheet approach into the nip of the feeding roller 104. In order to prevent such a problem, the sheet holding members 401 are disposed in order to stabilize the sheet approach into the nip by ensuring that the approach angle of the sheet is not greater than a predetermined angle.

Further details of the procedure of invention are explained below with reference to FIGS. 9A and 9B.

Figure 9A:
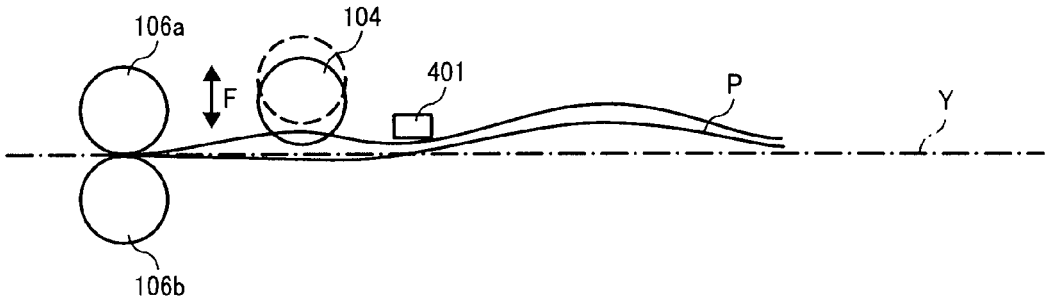
FIG. 9A illustrates a conventional example of a sheet holding member.

FIG. 9A shows a conventional arrangement in which the sheet holding members 401 are upstream from the feeding roller 104 with respect to the sheet feeding direction in the sheet path Y.

Figure 9B:
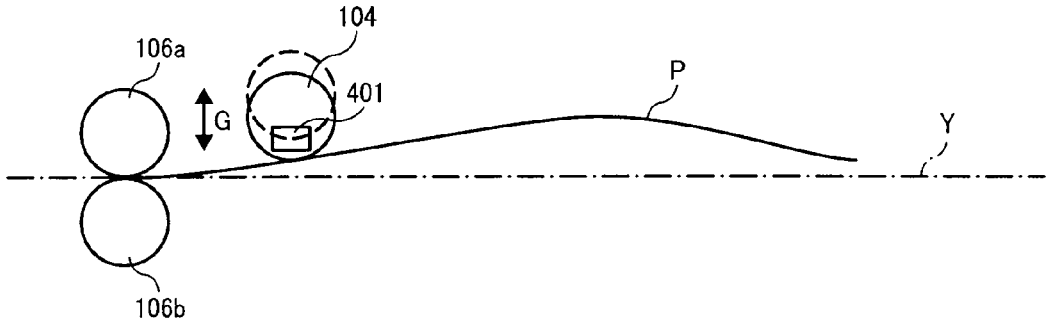
FIG. 9B illustrates an example of a sheet holding member according to an exemplary embodiment.

FIG. 9B shows an arrangement according to the invention in which the sheet holding members 401 are at the substantially same position as the feeding roller 104 in the sheet path Y.

In the arrangement shown in FIG. 9A, when the feeding roller 104 moves up and down as shown an arrow F, the sheet P violently moves up and down under the feeding roller 104. On the other hand, as shown in FIG. 9B, in the present invention, even when the feeding roller 104 moves violently up and down as shown an arrow G, the sheet does not move because the sheet holding members 401 hold the sheet P tightly. Consequently, the feeding executed by the feeding roller 104 becomes more accurate. In other words, because the sheet contacts the feeding roller 104 at the correct predetermined angle, the feeding by the feeding roller 104 becomes more accurate.

Moreover, the handling of the sheets is explained below with reference to FIGS. 10A and 10B.

Figure 10A:
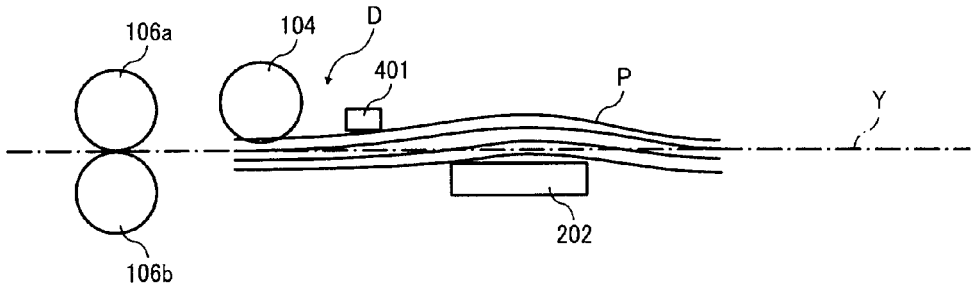
FIG. 10A illustrates a conventional example of a sheet holding member.
Figure 10B:
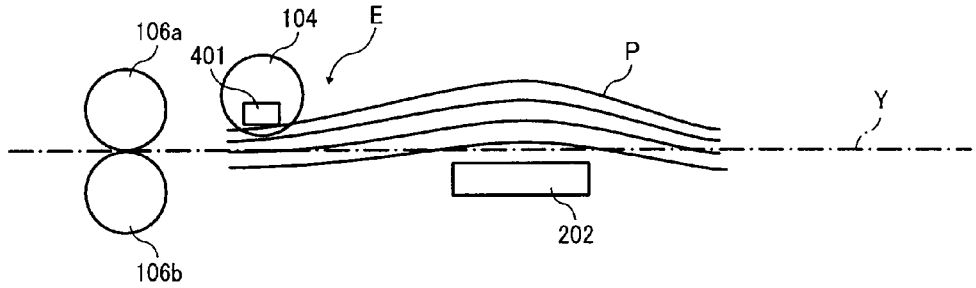
FIG. 10B illustrates an example of a sheet holding member according to an exemplary embodiment.

In a conventional example shown in FIG. 10A, air flow is unable to easily enter into an area that is shown with an arrow D in FIG. 10A. As a result, the system's ability to handle of the sheets is decreased. On the other hand, as shown in FIG. 10B, in the present invention, the sheets are able to move freely in the area that is shown with an arrow E in FIG. 10B because there is not a regulation member between the opening of the air outlet 202 and the feeding roller 104, thus allowing air to easily enter into this area. Consequently, the handling performance is improved in the arrangement shown in FIG. 10A.

Figure 11:
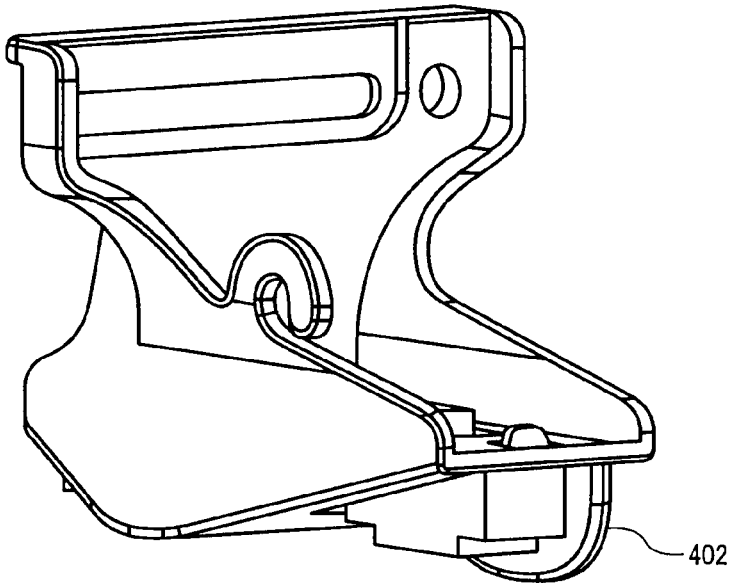
FIG. 11 illustrates an example of a sheet holding member according to an another exemplary embodiment.
Figure 12:
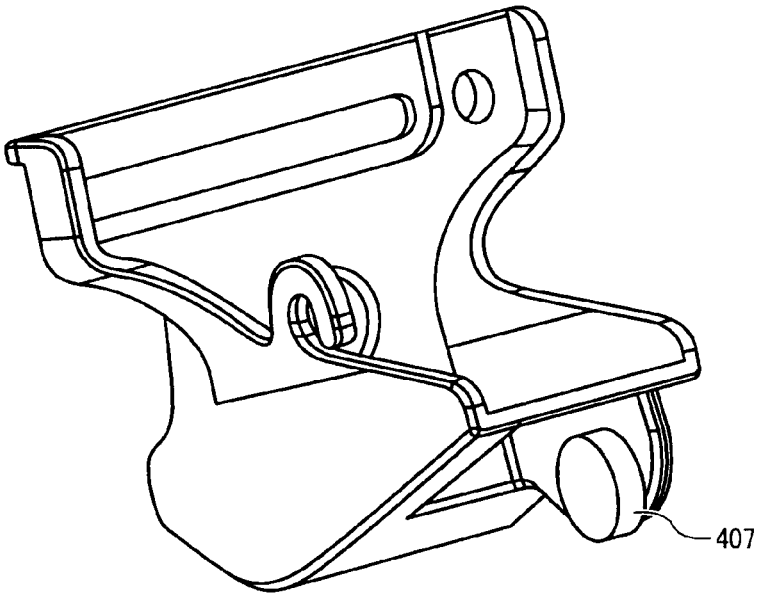
FIG. 12 illustrates an example of a sheet holding member according to another exemplary embodiment including a roller.

In addition, sheet holding projection 402 shown in FIG. 11 and a roller 407 shown in FIG. 12 can also be used as sheet holding members 401. Further, in the example shown in FIG. 5, a sensor bracket 403, which is near the feeding roller 104, has the function of the sheet hold projection 402 by constituting it to one element.

Moreover, additional embodiments of the sheet holding members 401 are explained below with reference to FIGS. 13 and 14.

Figure 13:
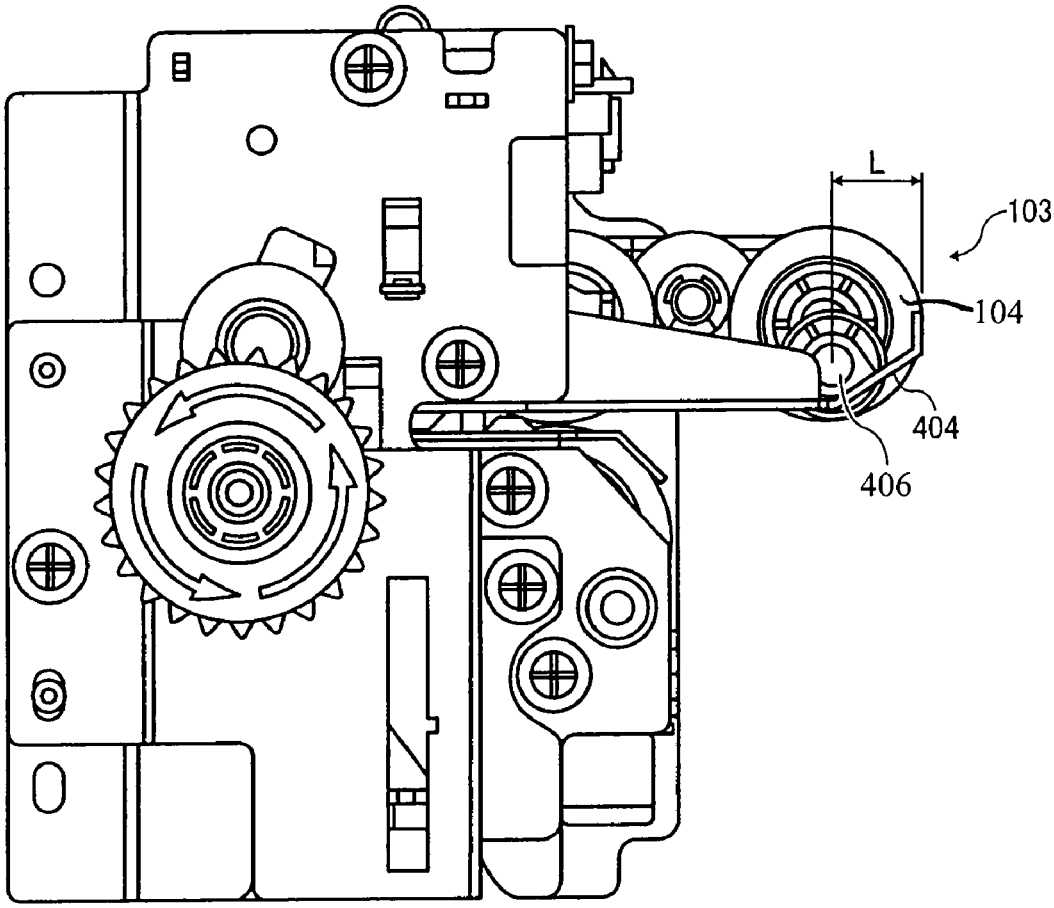
FIG. 13 illustrates an example of a sheet holding member according to another exemplary embodiment.
Figure 14:
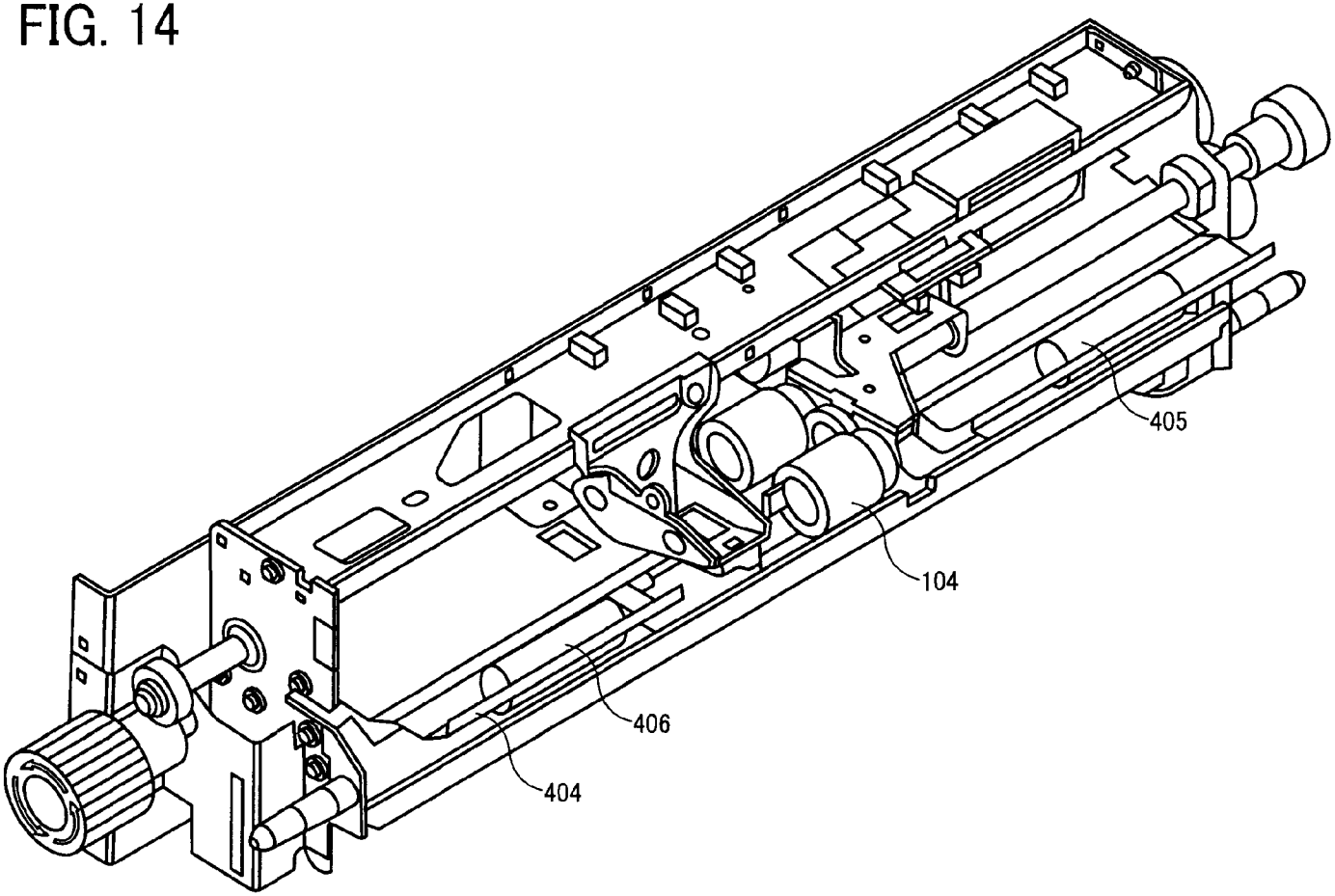
FIG. 14 illustrates an example of a sheet holding member according to another exemplary embodiment including a roller.

As shown in FIG. 13, an arrangement in which an upper guide plate 404 of the sheet feeding unit 103 is projected having a predetermined length L from the center of the feeding roller 104 is also possible. By projecting the upper guide plate 404 of the sheet feeding unit 103 a predetermined length L from the center of the feeding roller 104 as a sheet holding member, the sheet is still able to be fed correctly even when the sheet is curled. In addition, the surface treatment of the upper guide plate 404 preferably includes a coating of nickel plating or fluorocarbon resin as these materials can reduce the feeding resistance of the sheet.

If the sheet is pushed to the upper guide plate 404 due to floating produced by air flow, feeding resistance of sheet may occur. In order to prevent this negative effect, it preferable that roller 405 and roller 406 be symmetrically arranged with respect to the feeding roller 104 and with respect to the sheet feeding direction. It is also possible that a curved member be arranged instead of the rollers so as to prevent the feeding resistance. Moreover, it is possible to adjust a sheet position arbitrarily by rotating the rollers 405, 406 or the curved member.

Numerous additional modifications and variations are possible in light of the above teachings. It is therefore to be understood that within the scope of the appended claims, the disclosure of the present invention may be practiced otherwise than as specifically described herein.

In the above mentioned example, air is used as a floating device. However the present invention is not limited to air, as long the substance can be arranged to produce wind pressure.

In the above mentioned example, an image forming apparatus is used as an example. However the invention is not limited in an image forming apparatus. It is possible to apply the present invention to any apparatus that requires effective handling of media in feeding such an apparatus for handling paper money, etc.

What is claimed is:

1. A media feeding apparatus comprising:

a media storage device which stores media;

a media feeding device which feeds each one of the media sequentially in a media feeding direction;

a blowing device which blows toward a side surface, of the media, that is disposed parallel to the media feeding direction; and a media holding member having an inclined portion which holds the media and directs air blowing from the blowing device to flow away from the media feeding device and back towards a side of the media storage device, wherein the media feeding device and the inclined portion of the media holding member are arranged in such a manner that a plane of projection of both the media feeding device and the inclined portion of the media holding member overlap or coincide in a direction perpendicular to the media feeding direction, wherein the media holding member and the media feeding device are arranged such that the media feeding device moves independently of the media holding member in a vertical direction perpendicular to the media feeding direction, wherein the media holding member is an upper guide plate of the media feeding device, and wherein the upper guide plate projects past the media feeding device in an opposite direction with respect to the media feeding direction.

2. The media feeding apparatus according to claim 1, wherein the upper guide plate includes a roller.

3. The media feeding apparatus according to claim 2, wherein the media holding member holds the media by a roller.

4. The media feeding apparatus according to claim 1, wherein the media holding member holds the media by a projection.

5. An image forming apparatus or a sheet processing apparatus comprising the media feeding apparatus according to claim 1.

6. The image forming apparatus or sheet processing apparatus according to claim 5, further comprising an image forming unit, wherein the media feeding apparatus feeds the media towards the image forming unit.

7. The media feeding apparatus according to claim 1, wherein the media feeding device feeds the uppermost of the stored media sequentially.

8. The media feeding apparatus according to claim 1, wherein the blowing device blows air toward the side surface of the media such that the air turns toward the media feeding direction and then turns back toward the side surface of the media before reaching the media feeding device.

9. A media feeding apparatus comprising:

a media storage device which stores media;

a media feeding device which feeds each one of the media sequentially in a media feeding direction;

a blowing device which blows toward a side surface, of the media, that is disposed parallel to the media feeding direction; and a media holding member having an inclined portion which holds the media and directs air blowing from the blowing device to flow away from the media feeding device and back towards a side of the media storage device, wherein the media feeding device and the inclined portion of the media holding member are arranged in such a manner that a plane of projection of both the media feeding device and the inclined portion of the media holding member overlap or coincide in a direction perpendicular to the media feeding direction, wherein the media holding member and the media feeding device are arranged such that the media feeding device moves independently of the media holding member in a vertical direction perpendicular to the media feeding direction, wherein the media holding member holds the media by a plate, wherein the media holding member is an upper guide plate of the media feeding device, and wherein the upper guide plate projects past the media feeding device in an opposite direction with respect to the media feeding direction.

10. The media feeding apparatus according to claim 9, wherein the upper guide plate includes a roller.

11. An image forming apparatus or a sheet processing apparatus comprising the media feeding apparatus according to claim 9.

12. The image forming apparatus or sheet processing apparatus according to claim 11, further comprising an image forming unit, wherein the media feeding apparatus feeds the media towards the image forming unit.

13. The media feeding apparatus according to claim 9, wherein the media feeding device feeds the uppermost of the stored media sequentially.

14. The media feeding apparatus according to claim 9, wherein the blowing device blows air toward the side surface of the media such that the air turns toward the media feeding direction and then turns back toward the side surface of the media before reaching the media feeding device.

15. A media feeding apparatus comprising:

a media storage device which stores media;

a media feeding device which feeds each one of the media sequentially in a media feeding direction;

a blowing device which blows toward a side surface, of the media, that is disposed parallel to the media feeding direction; and a media holding member having an inclined portion which holds the media and directs air blowing from the blowing device to flow away from the media feeding device and back towards a side of the media storage device, wherein the media feeding device and the inclined portion of the media holding member are arranged in such a manner that a plane of projection of both the media feeding device and the inclined portion of the media holding member overlap or coincide in a direction perpendicular to the media feeding direction, wherein the media holding member and the media feeding device are arranged such that the media feeding device moves independently of the media holding member in a vertical direction perpendicular to the media feeding direction, and wherein the media holding member holds the media by a roller.

16. An image forming apparatus or a sheet processing apparatus comprising the media feeding apparatus according to claim 15.

17. The image forming apparatus or sheet processing apparatus according to claim 16, further comprising an image forming unit, wherein the media feeding apparatus feeds the media towards the image forming unit.

18. The media feeding apparatus according to claim 15, wherein the media feeding device feeds the uppermost of the stored media sequentially.

19. The media feeding apparatus according to claim 15, wherein the blowing device blows air toward the side surface of the media such that the air turns toward the media feeding direction and then turns back toward the side surface of the media before reaching the media feeding device.

20. A media feeding apparatus comprising:

media storage means for storing media;

media feeding means for feeding each one of the media sequentially in a media feeding direction;

blowing means for blowing toward a side surface, of the media, that is disposed parallel to the media feeding direction; and media holding means for holding the media, the media holding means having an inclined portion, and for directing air blowing from the blowing means to flow away from the media feeding means and back towards a side of the media storage means, wherein the media feeding means and the inclined portion of the media holding means are arranged in such a manner that a plane of projection of both the media feeding means and the inclined portion of the media holding means overlap or coincide in a direction perpendicular to the media feeding direction, and wherein the media holding means and the media feeding means are arranged such that the media feeding means moves independently of the media holding means in a vertical direction perpendicular to the media feeding direction, wherein the media holding means is an upper guide plate of the media feeding means, and wherein the upper guide plate projects past the media feeding means in an opposite direction with respect to the media feeding direction.

* * * * *